US012648631B2

(12) United States Patent
Li

(10) Patent No.: US 12,648,631 B2
(45) Date of Patent: Jun. 9, 2026

(54) POWDER PUFF

(71) Applicant: Dong Li, Bengbu (CN)

(72) Inventor: Dong Li, Bengbu (CN)

(73) Assignee: Dong Li, Bengbu (CN)

( * ) Notice: Subject to any disclaimer, the term of this patent is extended or adjusted under 35 U.S.C. 154(b) by 173 days.

(21) Appl. No.: 18/400,206

(22) Filed: Dec. 29, 2023

(65) Prior Publication Data

US 2025/0134233 A1 May 1, 2025

(30) Foreign Application Priority Data

Oct. 27, 2023 (CN) ..... 202322922351.5
Dec. 25, 2023 (CN) ..... 202323549823.3

(51) Int. Cl.
*A45D 33/36* (2006.01)

(52) U.S. Cl.
CPC ..... *A45D 33/36* (2013.01); *A45D 2200/1018* (2013.01)

(58) Field of Classification Search
CPC ..... A45D 33/36
USPC ..... 132/317
See application file for complete search history.

(56) References Cited

U.S. PATENT DOCUMENTS

| | | | | |
|---|---|---|---|---|
| 9,930,952 | B2 | 4/2018 | Kim | |
| 10,874,191 | B2 | 12/2020 | Oh et al. | |
| 11,076,674 | B2 * | 8/2021 | Chaillet-Piquand ... | A45D 40/26 |
| 2020/0187622 | A1 | 6/2020 | Jin | |
| 2020/0352306 | A1 | 11/2020 | Um | |

FOREIGN PATENT DOCUMENTS

| | | | |
|---|---|---|---|
| CN | 216776363 U | * | 6/2022 |
| CN | 218418810 U | * | 2/2023 |

* cited by examiner

*Primary Examiner* — Anna K Kinsaul

(57) ABSTRACT

A powder puff includes an elastic airbag and a cosmetic cover; the elastic airbag has a cavity; one end of the elastic airbag is provided with an air hole, an air-tight structure is arranged in the air hole and used for opening or closing the air hole; when the air hole is opened, the elastic airbag can be squeezed into a retracted state, or inhale spontaneously and restore elastically into an expanded state; the cosmetic cover covers the other end of the elastic airbag body. The elastic airbag may inhale autonomously, after the inflation is completed, the elastic airbag will stably support the cosmetic cover, which will not shake and is in a stable state, making it easy to apply makeup. The elastic airbag adopts an autonomous inhaling method, and the air pressure in the cavity is equal to the external air pressure.

8 Claims, 12 Drawing Sheets

POWDER PUFF

FIELD OF THE INVENTION

The present disclosure relates to the technical field of powder puff, particularly, to a powder puff, which can be compressed into a retracted state, or inhaled spontaneously and restored elastically into an expanded state.

BACKGROUND OF THE INVENTION powder puff is a type of cosmetic tool. Generally, a powder box contains a powder puff, which is mostly cotton and silk materials and is used to pick up a foundation and modify makeup.

In the prior art, powder puff is mostly made from solid sponge, which is inconvenient to be stored after being used. In addition, the solid sponge is used to suck up a liquid cosmetic product, and the liquid cosmetic product may enter the interior of the solid sponge, resulting in waste of the liquid cosmetic product, and the solid sponge is difficult to be washed and dried

SUMMARY OF THE INVENTION

The object of the present disclosure is to provide a powder puff, aiming to solve the problem that the powder puff in the prior art is inconvenient to store after being used.

In order to achieve the above object, the disclosure provides a powder puff, which includes an elastic airbag and a cosmetic cover.

The elastic airbag has a cavity; one end of the elastic airbag is provided with an air hole, an air-tight structure is arranged in the air hole and used for opening or closing the air hole; when the air hole is opened, the elastic airbag can be compressed into a retracted state, or inhale spontaneously and restore elastically into an expanded state.

The cosmetic cover covers the elastic airbag.

Optionally, the air-tight structure includes a one-way valve and a first plug, the one-way valve is arranged in the air hole and used for the air entering the cavity by an air port of the one-way valve when the elastic airbag is elastically restored; the first plug is arranged in the air hole and is used for opening the air port of the one-way valve when the elastic airbag is retracted.

Optionally, the one-way valve includes a valve body arranged in the air hole, the valve body is provided with an air channel having a port, the end of the air channel away from the port is provided with a V-shaped groove, the smaller end of the V-shaped groove faces the cavity, the bottom of the V-shaped groove is provided with the air port, and when the elastic airbag body is elastically restored, the air prop opens the air port into the cavity.

Optionally, the first plug includes an elastic part, arranged between the air hole and the valve body; the opposite ends of the elastic part are respectively provided with a plug end and a first pressing end, the first plug end penetrates through the air channel and has a gap therebetween, and the first pressing end extends towards the air hole; pressing the first pressing end to drive the first plug end to insert into the V-shaped groove for opening the air port; and the elastic part drives the first plug end to reset and be away from the V-shaped groove for closing the airport.

Optionally, the elastic airbag body is provided with a first connecting ring in communication with the cavity, the ring hole of the first connecting ring is the air hole, and the air-tight structure includes a seat detachably connected with the first connecting ring and sealed the air hole.

Optionally, the outer wall of the first connecting ring is provided with external thread, the seat is provided with a threaded hole, and the external thread is connected with the threaded hole.

Optionally, the elastic airbag includes an elastic airbag body with an airbag port and a cover body, the cover body seals the airbag port, the cavity is formed between the cover body and the elastic airbag body, the air hole is arranged on the cover body, a cosmetic cover covers the elastic airbag body.

Optionally, the elastic airbag body is provided with a first sealing ring in communication with the cavity, the ring opening of the first sealing ring is the airbag port. One end of the cover body protrudes to form a second connecting ring, the second connecting ring is inserted into the first sealing ring, and the first sealing ring and the second connecting ring are respectively provided a first sealed part and a sealed groove clamped with each other.

Optionally, the periphery of the airbag port is provided with a second sealing part, the end of the cover body is provided with a second sealing groove, and the second sealing part is accommodated in the second groove. A pressing ring is sleeved over the first sealing ring. The second sealing part is sealed and pressed between the cover body and the pressing ring.

Optionally, the inner wall of the cavity is provided with multiple strips, which are used to drive the elastic airbag to recover from a retracted state and to inhale autonomously into an expansion state.

Optionally, the inner wall of the air hole is provided with a mounting portion, which is provided with a first through hole; the air-tight structure is arranged in the air hole, comprising a second plug, an elastic member, and a sealing member; the elastic member elastically drives the sealing member to seal the first through hole to close the air hole; the second plug drives the sealing member to unseal the first through hole to open the air hole.

Optionally, the air hole is provided with a connecting member at an end close to the cavity; the connecting member is provided with at least one second through hole in communication with the air hole and the cavity; a mounting cavity is formed between the connecting member and the mounting portion in the air hole; the sealing member is disposed in the mounting cavity and close to the first through hole; the elastic member is disposed in the mounting cavity with both ends respectively abutting against the sealing member and the connecting member, the second plug is disposed in the first through hole and there is a gap therebetween; one end of the second plug is connected to or abuts against the sealing member, the other end of the second plug is the second pressing end; the second pressing end drives the sealing member away from the first through hole to unseal the first through hole.

Optionally, the side of the connecting member in the mounting cavity is provided with a positioning column, the sealing member is provided with a positioning slot at an end close to the elastic member, one end of the elastic member is sleeved outside of the positioning column, the other end of the elastic member is inserted into the positioning slot.

Optionally, the connecting member includes a connecting cover and a connecting sleeve extending outwards along the periphery of the connecting cover, the connecting sleeve is sleeved outside the air hole, and the second through hole is provided in the connecting cover.

Optionally, the sealing member is provided with a second sealing ring at an end close to the first through hole and seals the first through hole or unseals the first through hole with the second sealing ring.

Optionally, the elastic airbag is provided with a first connecting ring in communication with the cavity, the ring hole thereof is the air hole.

The powder puff further includes a handle, the handle is provided with a sealing seat detachably connected the first connecting ring and seals the air hole.

Optionally, the elastic airbag body includes an elastic airbag body with an airbag port and a cover body, the cover body seals to cover the airbag port, the cavity is formed between the cover body and the elastic airbag body, the air hole is arranged on the cover body, the cosmetic cover is sleeved out of the elastic airbag body.

Optionally, the outer surface of the elastic airbag body is provided with a texture, and the cosmetic sleeve is sleeved outside the texture.

Optionally, the inner wall of the cavity is provided with multiple strips, which are used to drive the elastic airbag to recover from a retracted state and inhale autonomously into an expansion state.

Compared with the prior art, the above one or more technical solutions in the powder puff provided in the embodiments of this disclosure have at least one of the following technical effects:

When not used, the air hole is open, and the user compresses the elastic airbag to deflate from the air hole, causing the elastic airbag to be compressed into a retracted state for easy storage.

When used, the air hole is open, and the elastic airbag is restored from the retracted state and inhales autonomously into an expanded state. The elastic airbag will inflate without the need for manual inflation. After inflation, the elastic airbag will stably support the cosmetic cover, which will not shake and is in a stable state, making it easy to apply makeup.

When used, only the cosmetic cover absorbs liquid foundation, the elastic airbag will not absorb liquid foundation, reducing the waste of liquid foundation, and it is easy to clean and dry the cosmetic cover, which is clean and sanitary.

The elastic airbag adopts an autonomous inhaling method, and the air pressure in the cavity is equal to the external air pressure. The elastic airbag supports the cosmetic cover, making it more elastic and providing better feedback compared to the existing powder puffs. It fits the face more closely, and can continuously and evenly apply makeup. The makeup effect is good, and it avoids the discomfort caused by excessive or insufficient inflation of the elastic airbag.

When not use, the air hole is open by removing the air-tight structure, the user squeezes the elastic airbag to deflate from the air hole, the elastic airbag is squeezed into a retracted state, then the air hole is closed by the air-tight structure, the elastic airbag keeps at the retracted state, making the powder puff easier to store.

when use, the air hole is open through the air-tight structure, the elastic airbag restores from the retracted state and inhales autonomously into an expanded state. The elastic airbag inflates autonomously without manual inflation, which is easy to use with high convenience. After inflation, the air hole is closed through the air-tight structure to maintain the elastic airbag in an expanded state so that the elastic airbag stably supports the cosmetic cover, which does not shake and is in a stable state, making it easy to apply make up.

When use, the user applies force to drive the second plug to bring the sealing member away from the first through hole and compress the elastic member, thereby the sealing member unseal the first through hole to open the air hole; the elastic airbag restores from the retracted state and inhales autonomously into an expanded state; compared with the inhaling manner with one-way valve, the autonomously inhaling manner has the advantages of faster speed, saving times.

BRIEF DESCRIPTION OF THE DRAWINGS

In order to more clearly illustrate the technical schemes in the embodiments in the present invention, the drawings needed in the embodiments or the prior technical description are briefly introduced below. Obviously, the drawings described below are only some embodiments in the present invention, and for those skilled in the art, additional drawings may be obtained according to the drawings below without creative work.

EMBODIMENTS

Embodiments of the present disclosure are described in detail below, and examples of the embodiments are shown in the attached drawings, in which the same or similar labels represent the same or similar elements or elements with the same or similar function. The embodiments described below by reference to the attached drawings are exemplary and are intended to explain embodiments of the present invention and cannot be understood as limits in the present invention.

In the description of the embodiments of the present invention, it should be understood that if the embodiments involve directional indications, such as the "upper", "lower", "left", "right", "front", "rear", "internal" and "external", etc. indicating orientation or location relationship, is based on the orientation or position relationship showed in the figures, it is only for describing the embodiments in the present invention and simplifying the description, rather than indicating or implying the device or the element that must have a specificed azimuth, constructed and operated, it cannot be understood as a limitation on the present invention.

Further, the terms "first", and "second" are used only for description purposes, and cannot be understood as indicating or implying relative importance or implicitly indicating the number of technical features indicated. Thus, features defining "first" and "second" may expressly or implicitly include one or more of the features. In the description of the embodiments of the present invention, the "plurality of" means two or more unless otherwise specifically limits.

In the embodiments of the present invention, unless otherwise specified and defined, the terms "installation", "connection", "connection", "fixation" and other terms shall be understood in a broad sense, for example, they can be fixed connection, detachable connection, or integrated; It may be a mechanical connection or an electrical connection; It can be directly connected or indirectly connected through an intermediate medium. It can be the connection between two elements or the interaction between two elements. For those skilled in the art, the specific meanings of the above terms in the embodiments of the present invention can be understood according to specific circumstances.

In an embodiment in the disclosure, referring to FIGS. 1-6, a powder puff includes an elastic airbag 100 and a cosmetic cover 300.

Figure 1:
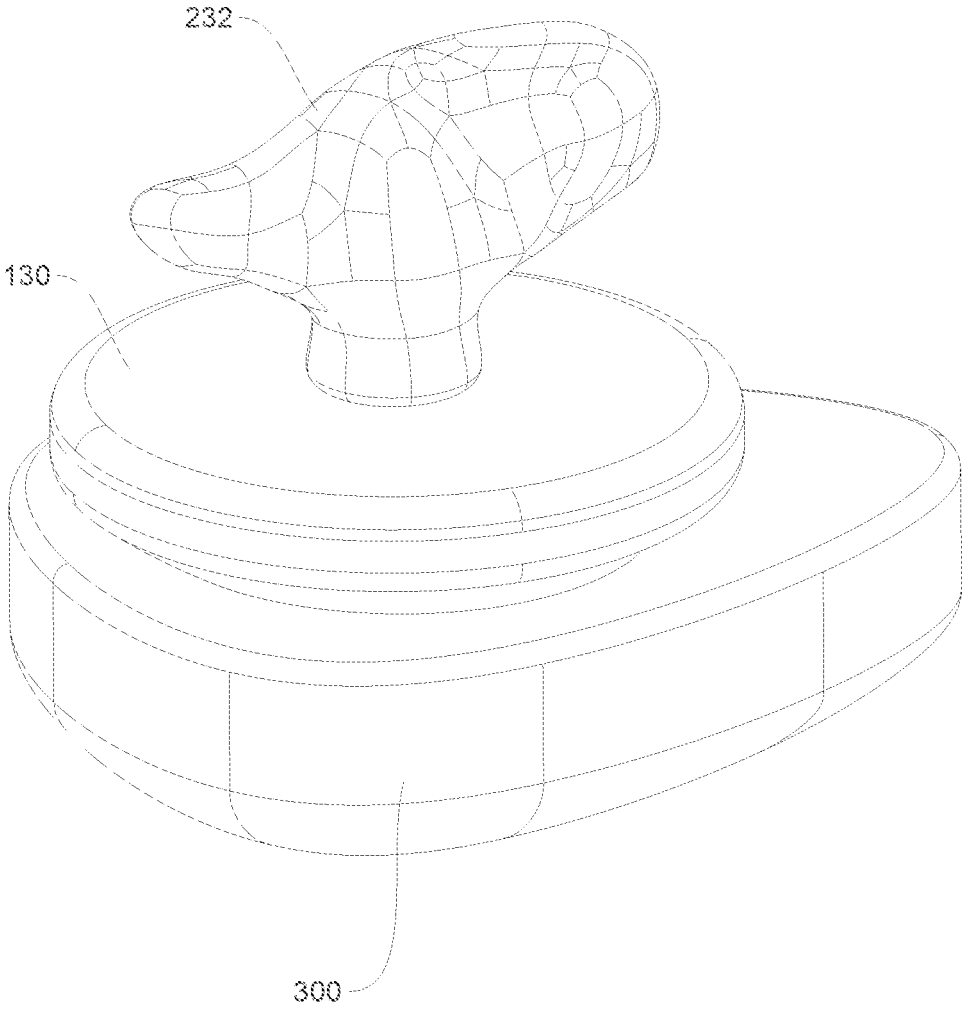
FIG. 1 is a perspective view of the powder puff according to an embodiment of the present disclosure.
Figure 2:
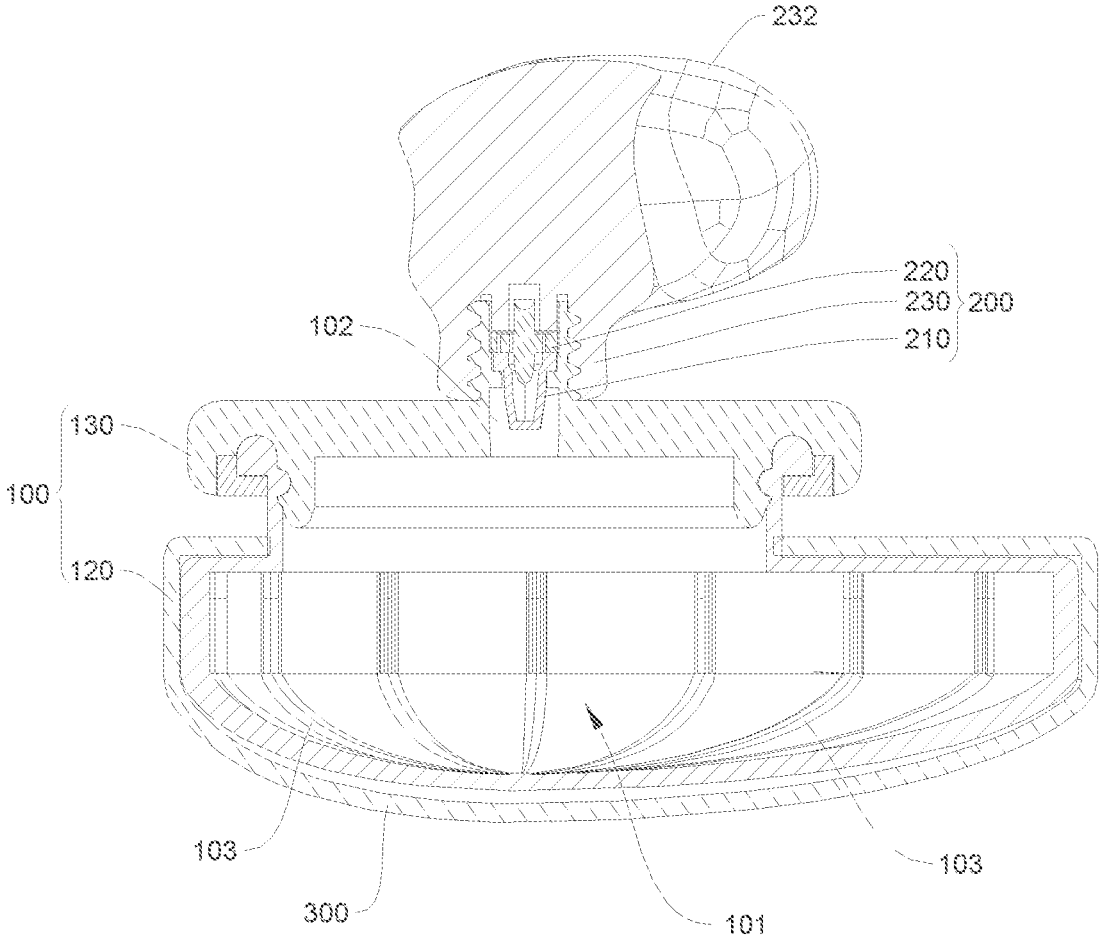
FIG. 2 is a section view of FIG. 1.

Referring to FIG. 1 and FIG. 2, an elastic airbag 100 having a cavity 101; one end of the elastic airbag 100 is provided with an air hole 102 in communication with the cavity 101, an air-tight structure 200 is arranged in the air hole 102 and used for opening or closing the air hole 102. The elastic airbag 100 has elasticity, when the air hole 102 is opened, the elastic airbag 100 can be squeezed into a retracted state, or inhales spontaneously and restores elastically into an expanded state.

Referring to FIG. 1 and FIG. 2, the cosmetic cover 300 covers the elastic airbag 100, the cosmetic cover 300 is used to apply liquid foundation when making up. Specifically, the cosmetic cover 300 can be made of sponge, velvet, etc. Preferably, the cosmetic cover 300 is made of sponge, which is soft enough, has good water absorption, and is more suitable for coating liquid foundation.

Compared with the prior art, the above one or more technical solutions about the powder puff provided according to the embodiments in this disclosure have at least one of the following technical effects:

Referring to FIGS. 1-2, when not used, the air hole 102 is open, the user squeezes the elastic airbag 100 to deflate from the air hole 102, the elastic airbag 100 is squeezeed into a retracted state, then the air hole 102 is closed, the elastic airbag 100 keeps at the retracted state, making the powder puff easier to store.

Referring to FIGS. 1-2, when used, the air hole 102 is open, the elastic airbag 100 restores from the retracted state and inhales autonomously into an expanded state. The elastic airbag inflates without manual inflation. After inflation, the elastic airbag 100 stably supports the cosmetic cover 300, which does not shake and is in a stable state, making it easy to apply makeup. It should be noted that during the elastic recovery process of the elastic airbag 100, the volume of the cavity 101 increases and the air pressure therein decreases, it is necessary to inhale external air from the air hole 102 until the air pressure in the cavity 101 is equal to the external air pressure. At this point, the elastic airbag 100 stops inflating and the air hole 102 is closed.

Referring to FIGS. 1-2, the elastic airbag 100 adopts an autonomous inhaling method, and the air pressure in the cavity 101 is equal to the external air pressure. The elastic airbag 100 supports the cosmetic cover 300, making it more elasticity and providing better feedback compared to the existing powder puffs. It fits the user's face more closely, and can continuously and evenly apply makeup. The makeup effect is good, and it avoids the discomfort caused by excessive or insufficient inflation of the elastic airbag 100.

In the other embodiment in the disclosure, the air-tight structure 200 includes a valve arranged in the air hole 102, the valve is used to open and close the air hole 102.

Figure 3:
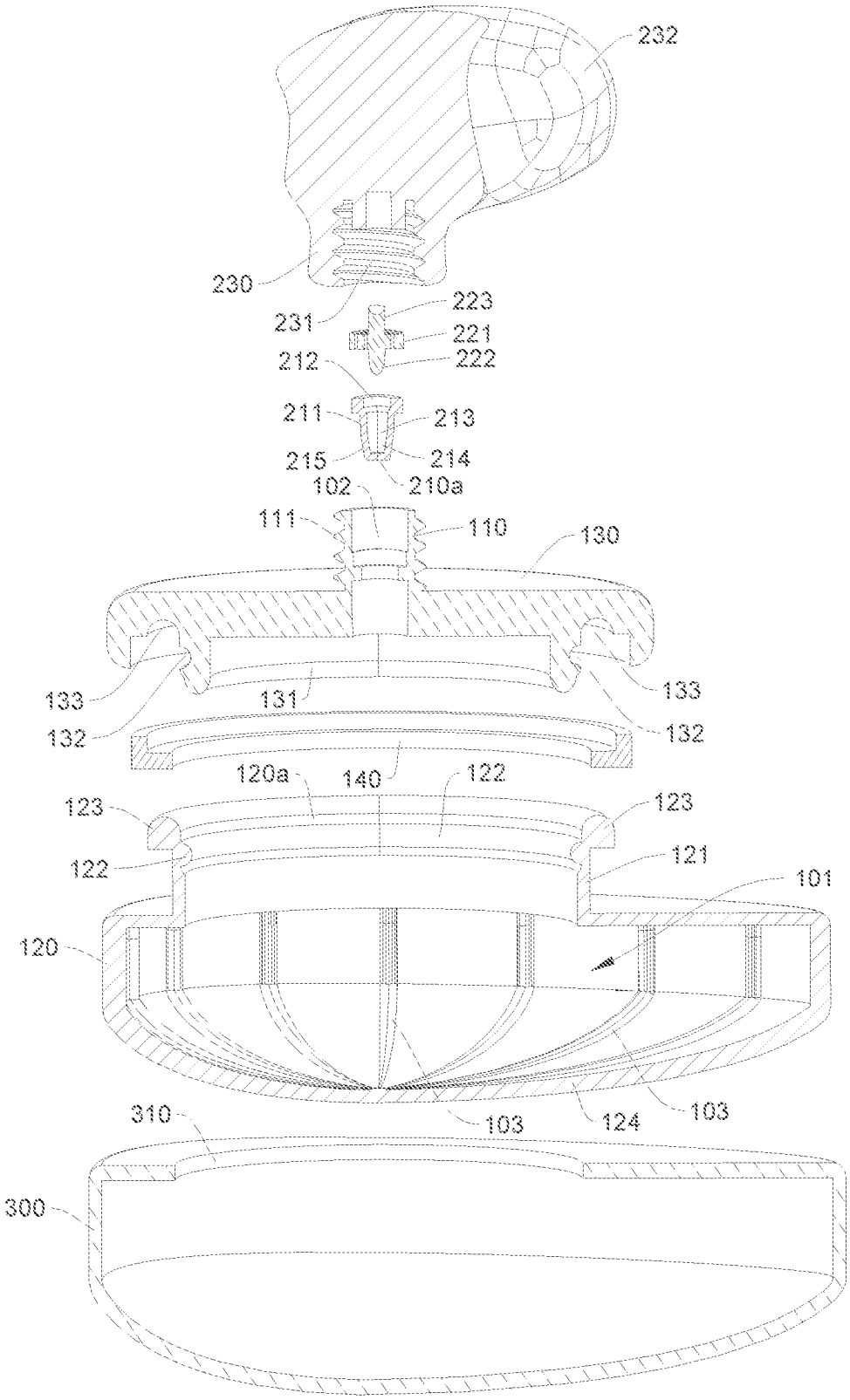
FIG. 3 is an exploded view of FIG. 2.

In the other embodiment in the disclosure, referring to FIGS. 2-3, the air-tight structure 200 includes a one-way valve 210 and a first plug 220, the one-way valve 210 is arranged in the air hole 102 and is used for the air entering the cavity 101 by a port 210*a* of the one-way valve 210 when the elastic airbag 100 is elastically restored. It should be noted that during the elastic recovery process of the elastic airbag 100, the air pressure in the cavity 101 is smaller than the external air pressure, thereby the external air props open the port 210*a* (that is the port 210*a* is opened) and enters the cavity 101, achieve inhale autonomously. After the elastic airbag 100 is restored in the expanded state, the air pressure in the cavity 101 is equal to the external pressure, the port 210*a* of the one-way valve 210 is restored to close (that is close the air hole 102). Since the one-way valve 210 is unidirectional conduction, the users press the elastic airbag 100 when they apply makeup, and the air in the cavity 101 will not be discharged from the port 210*a* of the one-way valve 210 to the outside, ensuring the good elasticity and support of the elastic airbag 100, so that it can stably support the cosmetic cover 300 after inflation.

Referring to FIGS. 2-3, the first plug 220 is arranged in the air hole 102, used for opening the airport 210*a* of the one-way valve 210 when the elastic airbag 100 is retracted. Specifically, the first plug 220 is used to opening the airport 210*a*, at this point, the users compress the elastic airbag 100 to deflate from the airport 210*a*, causing the elastic airbag to be compressed into a retracted state for easy storage and disassemble the cosmetic cover 300. After deflation, the first plug 220 leaves the airport 210*a* of the one-way valve 210, the airport 210*a* is closed.

Further, referring to FIGS. 2-3, the one-way valve 210 includes a valve body 211 arranged in the air hole 102. Specifically, the valve body 211 can be mounted in the air hole 10 through clamping or bonding methods. The valve body 211 is provided with an air channel 213 having a port 212, the end of the air channel 213 away from the port 212 is provided with a V-shaped groove 214, the smaller end of the V-shaped groove 214 faces the cavity 101, the bottom of the V-shaped groove 214 is provided with the air port 210*a*. When the elastic airbag 100 is elastically restored, the external air props open the air port 210*a* into the cavity 101 by pushing the inclined surfaces on both sides of the V-shaped part 215 towards each other away from each other. After the air pressure in the cavity 101 is equal to that of the outside. The V-shaped groove 214 is elastically restored to close the air port 210*a*. When the elastic airbag 100 is compressed during making up, the air port 210*a* won't be opened.

Preferably, referring to FIGS. 2-3, the valve body 211 is provided with an V-shaped part 215 at one side close to the cavity 101, the airport 210*a* is located at the smaller end of the V-shaped part 215. The elastic airbag 100 is compressed during makeup, the air pressure in the cavity 101 will push the inclined surfaces on both sides of the V-shaped part 215 towards each other, thus tightly closing the airport 210*a* and stabilizing the structure.

Further, referring to FIGS. 2-3, the first plug 220 includes an elastic portion 221, arranged between the air hole 102 and the valve body 211. Specifically, the elastic portion 221 may be mounted in the air hole 102 by clamped, adhesive method. The two opposite ends of the elastic portion 221 are respectively provided with a plug end 222 and a first pressing end 223, the first plug end 222 is arranged in the air channel 213 and there is a gap between the two, which is used for the air to pass through. The first pressing end extends towards the air hole 102. The user presses the first pressing end 223 downwards, driving the first plug end 222 to extend into the V-shaped groove 214 and push the inclined surfaces on both sides of the V-shaped groove 214 away from each other, thereby opening the airport 210*a*. At the same time, the elastic portion 221 elastically deforms. After stop pressing, the elastic portion 221 is elastically reset to drive the first plug end 222 away from the V-shaped groove 214, and the V-shaped groove 214 is elastically reset to close the airport 210*a*. Preferably, the first pressing end 223 extends out of the air hole 102, facilitating the user to press the first pressing end 223.

Further, referring to FIG. 3, the elastic portion 221 is helical, so that the elasticity of the elastic portion 221 is good, and the first plug end 222 and the first pressing end 223 are respectively disposed at two ends of the elastic portion 221.

In the other embodiment in the present disclosure, referring to FIG. 3, the elastic airbag 100 is provided with a first connecting ring 110 in communication with the cavity 101, the ring hole thereof is the air hole 102. The air-tight structure 200 also includes a seat 230. The seat 230 is detachably connected the first connecting ring 110 and seals the air hole 102. The seat 230 is detachably connected the first connecting ring 110 by means of screwing, clamping, or the like, so as to facilitate disassembly and assembly.

Further, referring to FIG. 3, the outer wall of the first connecting ring 110 is provided with external thread 111, the seat 230 is provided with a threaded hole 231, the external thread 111 is connected with the threaded hole 231, thereby detachably connecting the seat 230 to the first connecting ring 110, which has a simple structure and is convenient to assemble and disassemble. Alternatively, the inner wall of the first connecting ring 110 is provided with internal thread, the seat 230 is provided with a screw rod end, the screw rod end is connected with the internal thread, thereby detachably connecting the seat 230 to the first connecting ring 110, which has a simple structure and is convenient to assemble and disassemble. Preferably, the first sealing ring is disposed between the seat 230 and the first connecting ring 110, thereby further improving the sealing performance between the seat 230 and the first connecting ring 110.

In the embodiments, referring to FIGS. 2-3, the seat 230, the one-way valve 210, and the first plug end 220 are used in the same time, the one-way valve 210 has a primary gas sealing function for the air hole 102 (namely, the air in the cavity 101 cannot be discharged to the outside from the airport 210*a* of the one-way valve 210), The seat 230 provides a secondary gas sealing effect for the air hole 102, and further improves the sealing performance of the cavity 101 of the elastic airbag 100, thus, after inflation, the state of the elastic airbag 100 is stable, and natural air leakage is avoided.

Figure 5:
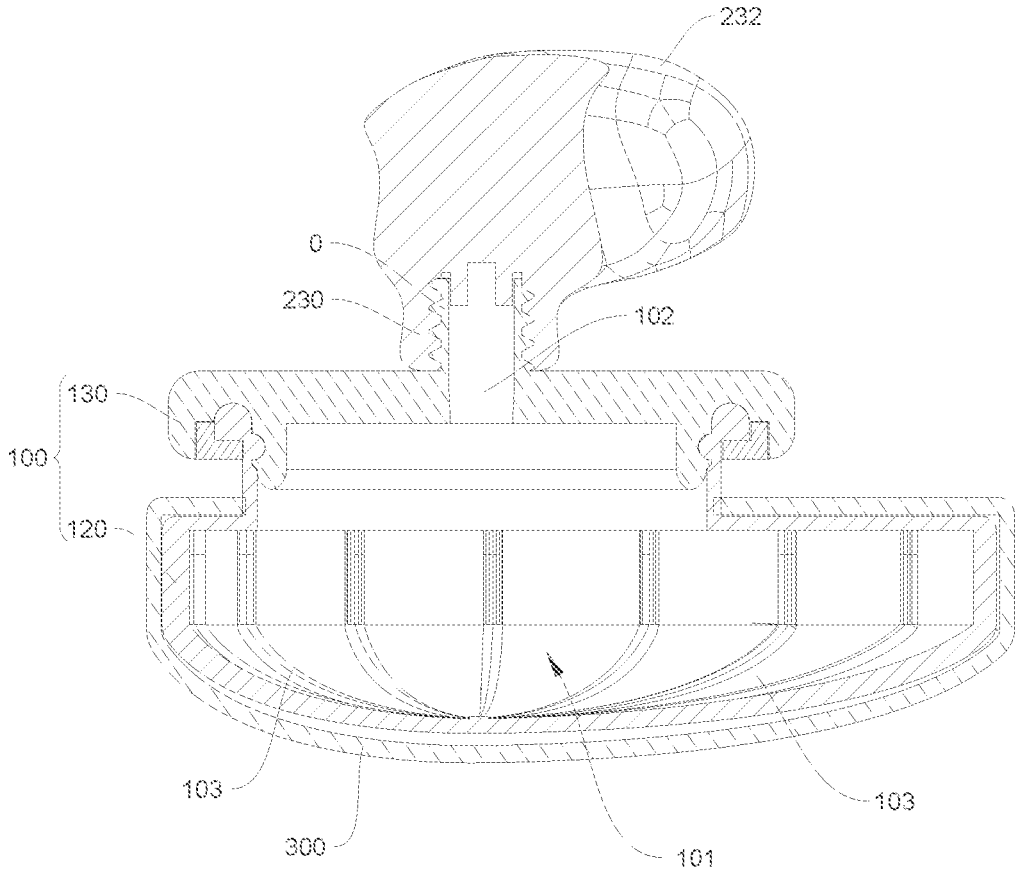
FIG. 5 is a section view of the powder puff according to another embodiment of the present disclosure.
Figure 6:
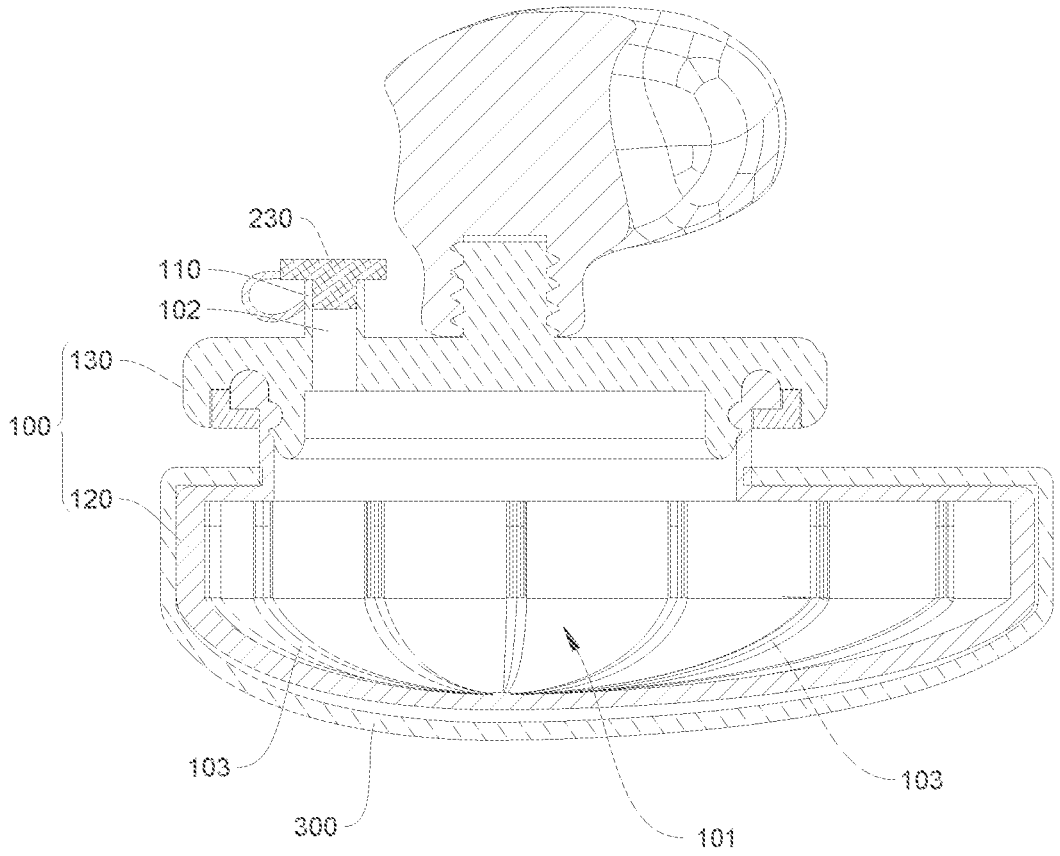
FIG. 6 is a section view of the powder puff according to another embodiment of the present disclosure.

In the embodiments, referring to FIGS. 5-6, the seat 230 can be used alone, namely there is no need to set the one-way valve 210 and the first plug end 220 inside the air hole 102. The user can remove the seat 230 from the first connecting ring 110 to open the air hole 102 and install the seat 230 on the first connecting ring 110 to close the air hole 102, which has a simple structure and low manufacturing cost. For example, referring to FIG. 6, the user can insert the seat 230 into the air hole 103 by interference fit to close the air hole 102 and pull out the sealing seat 230 from the air hole 102 to open the air hole 102.

In the embodiments, referring to FIG. 2 and FIG. 5, the seat 230 is provided with a handle 232 for user to grasp, facilitating the users to make up with the powder puff.

Figure 4:
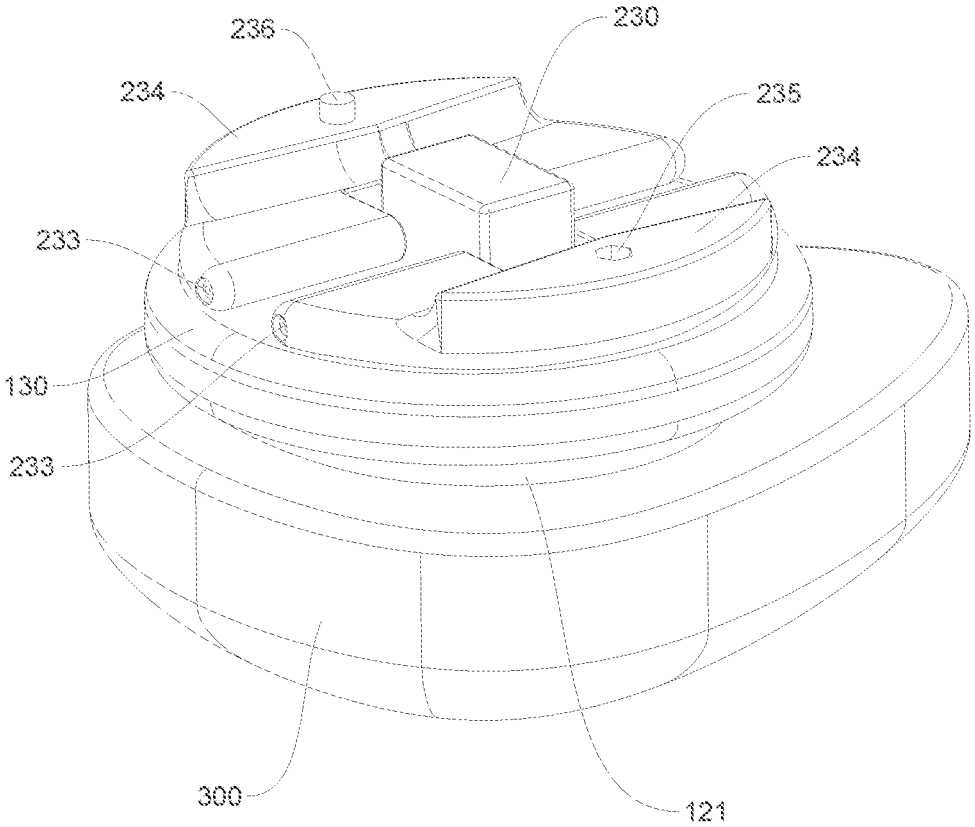
FIG. 4 is a perspective view of the powder puff according to the other embodiment of the present disclosure.

In the other embodiment, referring to FIG. 4, the two opposite sides of the seat 230 are respectively provided with handle pieces 234, rotating through a connecting shaft 233. The two handle pieces 234 can rotate to place flat on one end of the elastic airbag 100, so as to facilitate storage. Alternatively, the two handle pieces 234 can also rotate to fit together to form a holding portion, used for the user to hold, so that the user can make a makeup by using the powder puff.

Further, referring to FIG. 4, the two handle pieces 234 are respectively provided with the slot 235 and the protrusion 236, when the two handle pieces 234 are fit together, the slot 235 and the protrusion 236 are clamped so that the two handle pieces 234 are be assembled together.

In the other embodiment, one end of the elastic airbag 100 is provided with a strap (not shown) for fingers to pass through so that the users can use powder puffs for makeup.

In the other embodiment, referring to FIGS. 2-3, the elastic airbag 100 includes an elastic airbag body 120 with an airbag port 120*a* and a cover body 130. Specifically, the elastic airbag body 120 can be made from silicone, rubber, or latex, etc., without further limitation. Wherein, the cover body 130 seals the airbag port 120*a*, the cavity 101 is formed between the cover body 130 and the elastic airbag body 120, the air hole 102 is arranged on the cover body 130, the cosmetic cover 300 covers the elastic airbag body 120. The elastic airbag 100 is configured as a combination structure of the elastic airbag body 120 and the cover body 130 for easy processing.

In some other embodiments, referring to FIG. 2 and FIG. 3, the cosmetic cover 300 detachably covers the elastic airbag body 120, when the elastic airbag body 120 is in a retracted state, it is easy for the users to assemble the cosmetic cover 300 on the elastic airbag body 120 or remove it from the elastic airbag body 120, making it convenient for cleaning, drying, or replacing. Compared with existing solid sponge puffs, the elastic airbag 100 can be recycled, and only the cosmetic cover 300 needs to be replaced, reducing material loss, being economical and environmentally friendly, reducing manufacturing costs.

And, referring to FIG. 1 and FIG. 2, when used, only the cosmetic cover 300 applies liquid foundation, and the liquid foundation is adhesive on some range of the cosmetic cover 300. The elastic air bag 100 will not apply liquid foundation, reducing the waste of liquid foundation, and it is easy to clean and dry the cosmetic cover 300, which is clean and sanitary.

Specifically, referring to FIG. 2 and FIG. 3, the cosmetic cover 300 has an opening 310, the elastic airbag body 120 is inserted into the cosmetic cover 300 from the opening 310, so that the cosmetic cover 300 is detachably sheathed outside the elastic airbag body 120. The size of the opening 310 is smaller than that of the inner cavity of the cosmetic cover 300, so that the cosmetic cover 300 is firmly sleeved outside the elastic airbag body 120.

In some other embodiment, the cosmetic cover 300 also can be non-detachable structures, that is, the cosmetic cover 300 is sleeved on the other end of the elastic airbag 100 and fixedly connected to the outside of the elastic airbag body 120 by means of bonding.

Further, referring to FIGS. 2-3, the elastic airbag body 120 is provided with a sealing ring 121 in communication with the cavity 101, the ring opening of the first sealing ring 121 is the airbag port 120*a*. One end of the cover body 130 protrudes to form a second connecting ring 131, the second connecting ring 131 is inserted into the first sealing ring 121, and the first sealing ring 121 and the second connecting ring 131 are respectively provided a first sealed part 122 and a first sealed groove 132 clamped with each other. By the clamped connection of the first sealed part 122 and the sealed groove 132, the cover body 130 seals the first sealing ring 121 and the airbag port 120*a* with good sealing performance.

In the embodiments, referring to FIGS. 2-3, the first sealed part 122 is arranged at the inner wall of the first sealing ring 121, the first sealed groove 132 is arranged at the out wall of the second connecting ring 131. In the other embodiments, the first sealed part 122 is arranged at the outer wall of the second connecting ring 131, the first sealing groove 132 is arranged at the inner wall of the first sealing ring 121.

Further, referring to FIGS. 2-3, the periphery of the airbag port 120*a* is provided with a second sealing part 123, an end of the cover body 130 is provided with a second sealing groove 133, the second sealing part 123 is accommodated in the second sealing groove 133. A pressing ring 140 is sleeved over the first sealing ring 121. The second sealing part 123 is sealed and pressed between the cover body 130 and the pressing ring 140. The second sealing portion 123 is sealed and compressed by the cover body 130 and the pressing ring 140, thereby further improving the sealing tightness between the cover body 130 and the first sealing ring 121, stabilizing the state of the elastic airbag 100 after inflation, and preventing air leakage.

Specifically, the cover body 130, the second sealing part 123 and the pressing ring 140 can be fixed in a manner such as ultrasonic welding, glue bonding, or screwing.

Further, referring to FIGS. 1-2, the cover body 130 is smaller than the elastic airbag body 120, that is, the periphery of the cover body 130 does not protrude beyond the periphery of the elastic airbag body 120. When makeup is applied, the cosmetic cover 300 and the elastic airbag body 120 are deformed at a folded angle and tilted, thereby preventing the cover body 130 from making an impression on the makeup surface and the skin.

In the other embodiment, referring to FIGS. 2-3, the inner wall of the cavity 101 is provided with multiple strips 103, which are used to drive the elastic airbag 100 to recover from a retracted state and inhale autonomously into an expanded state. Specifically, the elastic airbag 100 is squeezed into the retracted state, the strips 103 is elastically deformed synchronously. When the air hole 102 is opened, the strips 103 elastically restores to drive the elastic airbag 100 to elastically restore to an expanded state from the retracted state, so that the elastic airbag 100 rapidly and autonomously inflates (inhales) into the expanded state, and the inflation speed is high.

It should be noted that the elastic airbag body 120 has elasticity, and the elastic airbag 100 can also be elastically restored to the expansion state from the retracted state without the strips 103. By the strips 103, the restoration (inflation) speed of the elastic airbag 100 can be improved.

Further, referring to FIG. 3, the elastic airbag body 120 has a front end of a circular arc face 124, and the cosmetic cover 300 is in a shape matched with the elastic airbag body 120, facilitating makeup.

Further, referring to FIGS. 2-3, the strips 103 extends from one end of the circular arc face 124 of the cavity 101 to the other end along the inner wall of the cavity 101, so that the strips 103 have a strong elastic potential when being elastically deformed, thereby quickly driving the elastic airbag 100 to be elastically restored from the retracted state to the expansion state, and the restoring (inflation) speed is fast.

The elastic airbag body 120 may be configured as any shapes, correspondingly, the cosmetic cover 300 is configured as a shape matched with the elastic airbag body 120 so that the cosmetic cover 300 can sleeved out of the elastic airbag body 120.

In the other embodiment, referring to FIGS. 7-10, another powder puff includes an elastic airbag 100 and a cosmetic cover 300 sleeved outside the elastic airbag 100.

Figure 7:
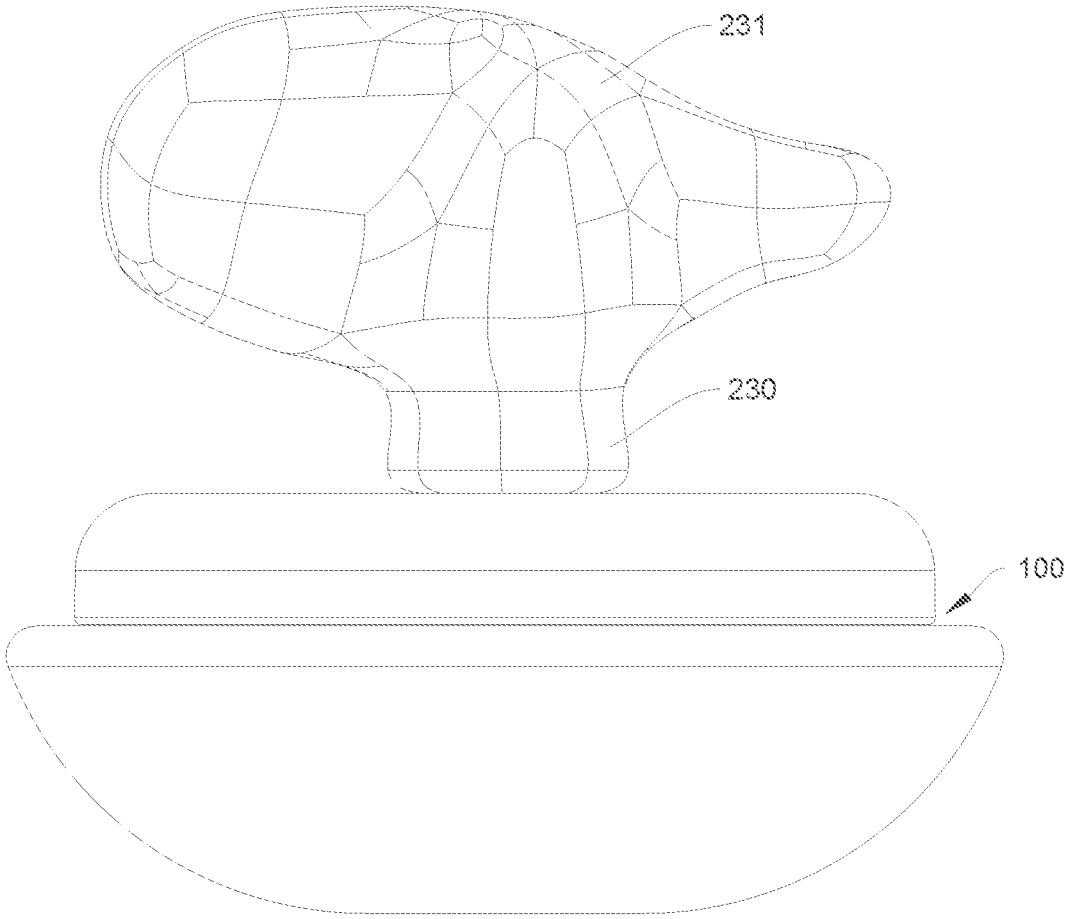
FIG. 7 is a perspective view of the powder puff according to an embodiment of the present disclosure.
Figure 8:
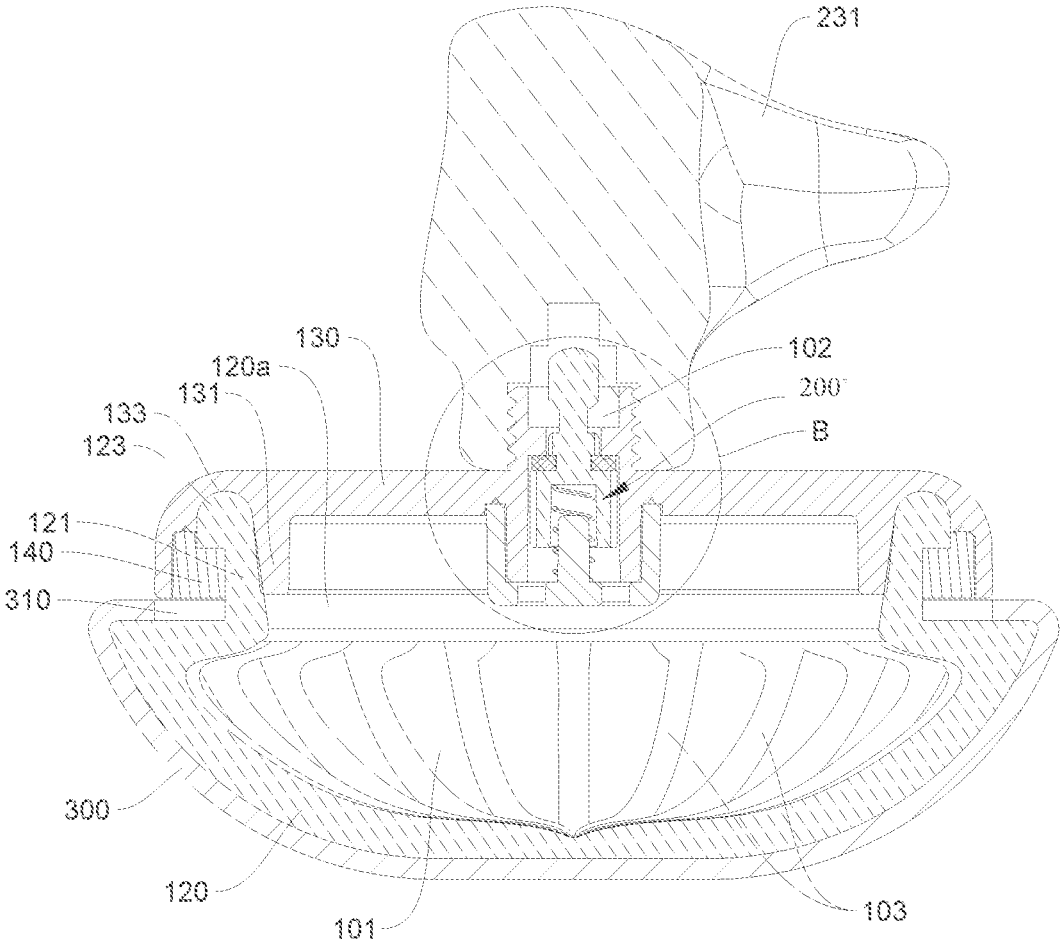
FIG. 8 is an sectional view of the powder puff according to an embodiment of the present disclosure.

Wherein, referring to FIGS. 7-8, the elastic airbag 100 has a cavity 101; the outer wall of the elastic airbag 100 is provided with an air hole 102 in communication with the cavity 101, an air-tight structure 200' is arranged in the air hole 102 and used for opening or closing the air hole 102. The elastic airbag 100 has elasticity, when the air hole 102 is opened, the elastic airbag 100 can be squeezed into a retracted state, or inhales spontaneously and restores elastically into an expanded state.

It should be noted that opening the air hole 102 means the cavity 101 is communicated with the outside through the air hole 103 and can exchange gas with the outside through the air hole 103, closing the air hole 102 means the air cavity 101 is not communicated with the outside and cannot exchange gas with the outside.

Wherein, referring to FIG. 8, the cosmetic cover 300 is used for applying liquid foundation when making up. Specifically, the cosmetic cover 300 can be made of sponge, or velvet, etc. The cosmetic cover 300 is preferably made of sponge, which is soft enough and has good water absorption, and is more suitable for coating liquid foundation.

Compared with the prior art, the above one or more technical solutions about the powder puff provided according to the embodiments in this disclosure have at least one of the following technical effects:

Referring to FIGS. 7-8, when not use, the air hole 102 is open by removing the air-tight structure 200', the user squeezes the elastic airbag 100 to deflate from the air hole 102, the elastic airbag 100 is squeezed into a retracted state, then the air hole 102 is closed by the air-tight structure 200', the elastic airbag 100 keeps at the retracted state, making the powder puff easier to store.

Referring to FIGS. 7-8, when use, the air hole 102 is open through the air-tight structure 200', the elastic airbag 100 restores from the retracted state and inhales autonomously into an expanded state. The elastic airbag inflates autonomously without manual inflation, which is easy to use with high convenience. After inflation, the air hole 102 is closed through the air-tight structure 200' to maintain the elastic airbag 100 in an expanded state so that the elastic airbag 100 stably supports the cosmetic cover 300, which does not shake and is in a stable state, making it easy to apply makeup.

It should be noted that during the elastic recovery process of the elastic airbag 100, the volume of the cavity 101 increases and the air pressure therein decreases, it is necessary to inhale external air into the cavity 100 from the air hole 102 until the air pressure in the cavity 101 is equal to the external air pressure. At this point, the elastic airbag 100 stops inflating and the air hole 102 is closed.

Referring to FIGS. 7-8, when making up, only the cosmetic cover 300 apply the liquid foundation, the elastic airbag 100 won't do, thereby reducing the waste of the liquid foundation, Moreover, the makeup sleeve 300 is easy to clean and dry, and is clean and sanitary, Referring to FIGS. 7-8, the elastic airbag 100 adopts an autonomous inhaling method, and the air pressure in the cavity 101 is consistent with the external air pressure. The elastic airbag 100 supports the cosmetic cover 300, making it more elastic and providing better feedback compared to the existing powder puffs. It fits the face more closely, and can continuously and evenly apply makeup. The makeup effect is good, and it avoids the discomfort caused by excessive or insufficient inflation of the elastic airbag 100.

Figure 9:
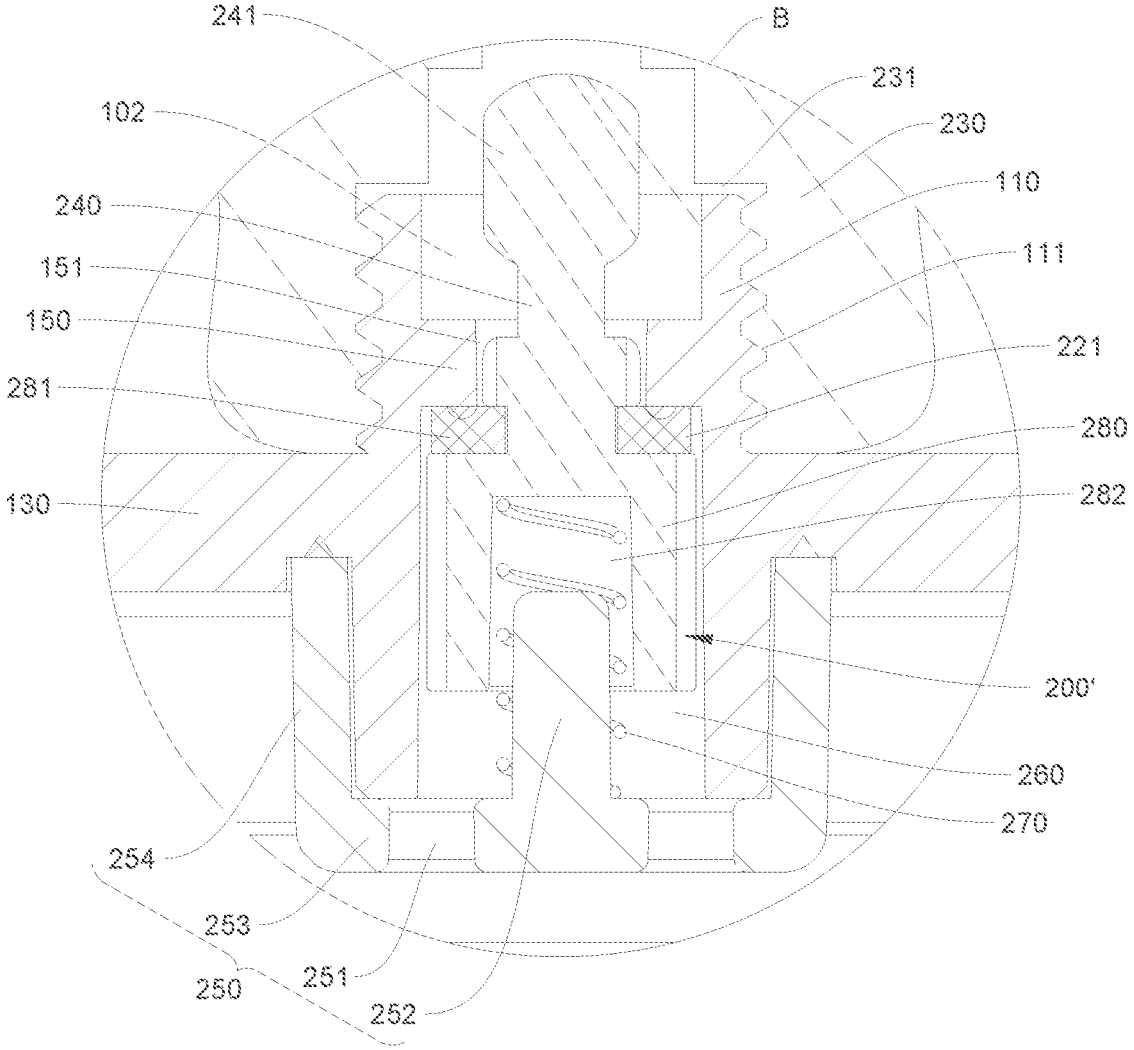
FIG. 9 is an enlarged view of the part A in FIG. 8.

In another embodiment, referring to FIGS. 8-9, the inner wall of the air hole 102 is provided with a mounting portion 150, which is provided with a first through hole 151. The air-tight structure 200' includes a second plug 240, an elastic member 270, and a sealing member 280, all arranged in the air hole 102. The elastic member 270 elastically drives the sealing member 280 to seal the first through hole 151 so as to close the air hole 102. The second plug 240 is used for driving the sealing member 280 to unseal the first through hole 151 so as to open the air hole 102.

Referring to FIGS. 8-9, when not use, the user applies force to drive the second plug 240 to bring the sealing member 280 away from the first through hole 151 and compress the elastic member 270, thereby the sealing member 280 unseal the first through hole 151 to open the air hole 102, at this time, the user squeezes the elastic airbag 100, the air in the elastic airbag 100 flows through the first through hole 151 and is expelled from the air hole 102, and the elastic airbag 100 is squeezed into a retracted state. Then the user does not apply force to the second plug 240, the elastic member 270 elastically restores to drive the sealing member 280 to be close to the first through hole 151, so that the sealing member 280 seals the first through hole 151, thereby maintaining the elastic airbag 100 in a retracted state and facilitating storage.

Referring to FIGS. 8-9, when use, the user applies force to drive the second plug 240 to bring the sealing member 280 away from the first through hole 151 and compress the elastic member 270, thereby the sealing member 280 unseal the first through hole 151 to open the air hole 102. The elastic airbag 100 restores from the retracted state and inhales autonomously into an expanded state. Compared with the inhaling manner with one-way valve, the autonomously inhaling manner has the advantages of faster speed, saving times. After the inhale is completed, the user does not apply force to the second plug 240, the elastic member 270 elastically restores to drive the sealing member 280 to be close to the first through hole 151, so that the sealing member 280 seals the first through hole 151, thereby maintaining the elastic airbag 100 in the expanded state so that the elastic airbag 100 stably supports the cosmetic cover 300, which does not shake and is in a stable state.

Further, referring to FIGS. 8-9, one end of the air hole 102 close to the cavity 101 is provided with a connecting member 250. The connecting member 250 is provided with at least one second through hole 251 in communication with the air hole 102 and the cavity 101. A mounting cavity 260 is formed between the connecting member 250 and the mounting portion 150 in the air hole 102. The sealing member 280 is disposed in the mounting cavity 260 and close to the first through hole 151. The elastic member 270 is disposed in the mounting cavity 260 with both ends respectively abutting against the sealing member 280 and the connecting member 250, and used for driving the sealing member 280 to block and seal the first through hole 151, thereby closing the air hole 102. The second plug 240 is disposed in the first through hole 151 and there is a gap therebetween. One end of the second plug 240 is connected to or abuts against the sealing member 280, the other end of the second plug 240 is the second pressing end 241. The second pressing end 241 drives the sealing member 280 away from the first through hole 151 to unseal the first through hole 151 to open the air hole 102. The cavity 101 is communicated with the outside through the second through hole 251, the first through hole 151, and the air hole 102. Preferably, at least a part of the second pressing end 241 extends out of the air hole 102, so that the user can conveniently press the second pressing end 241.

In the embodiment, the second plug 240 is formed integratly with the sealing member 280 with a stable structure. In some embodiments, the second plug 240 and the sealing member 280 may also be of a separated structure, and the second opening piece 240 is connected to the sealing member 280 by means of clamping, bonding, etc.

It should be noted that the sealing member 280 can inserted into the first through hole 151 to seal it, or the sealing member 280 hermetically abuts against the end wall of the mounting portion 150 to seal the first through hole 151, which is not limited herein.

Further, referring to FIGS. 8-9, the side of the connecting member 250 in the mounting cavity 260 is provided with a positioning column 252, the end of the sealing member 280 close to the elastic member 270 is provided with a positioning slot 282, one end of the elastic member 270 is sleeved outside of the positioning column 252, the other end of the elastic member 270 is inserted into the positioning slot 282 so that the elastic member 270 is stably mounted between the sealing member 280 and the connecting member 250 and is not prone to drift when performing a telescoping motion.

Preferably, the elastic member 270 is a spring with good elasticity and a simple structure.

Further, referring to FIGS. 8-9, the connecting member 250 includes a connecting cover 253 and a connecting sleeve 254 extending outwards along the periphery of the connecting cover 253, the connecting sleeve 254 is sleeved outside the air hole 102, and the second through hole 251 is provided in the connecting cover 253 to facilitate the installation of the connecting member 250. The connecting member 250 can be fixedly mounted outside the air hole 102 by means of clamping, bonding, ultrasonic welding, screwing and the like.

Further, referring to FIGS. 8-9, the sealing member 280 is provided with a second sealing ring 281 at an end close to the first through hole 151 and seals the first through hole 151 or unseals it with the second sealing ring 281. In a specific embodiment, the elastic return of the elastic piece 270 drives the second sealing ring 281 to bring the second sealing ring 281 to hermetically abut against the end wall of the mounting portion 150, thereby sealing the first through hole 151. Pressing the second pressing end 241 drives the sealing ring 280 to drive the second sealing ring 281 away from the end wall of the mounting part 150, so as to unseal the air ventilation hole 151.

In other embodiment, referring to FIGS. 8-9, the elastic return of the elastic piece 270 drives the second sealing ring 281 to insert into the first through hole 151, thereby sealing it. Pressing the second pressing end 241 drives the sealing ring 280 to drive the second sealing ring 281 away from the first through hole 151, so as to unseal it.

In another embodiment, referring to FIGS. 8-9, the elastic airbag 100 is provided with a first connecting ring 110 in communication with the cavity 101, the ring hole thereof is the air hole 102. The powder puff further includes a seat 230, the seat 230 is provided with a handle 232. The seat 230 is detachably connected the first connecting ring 110 and seals the air hole 102. The seat 230 is detachably connected the first connecting ring 110 by means of screwing, clamping, or the like, so as to facilitate disassembly and assembly. The handle 232 is used for the user to grasp, facilitating to make up with the powder puff.

Further, referring to FIGS. 8-9, the outer wall of the first connecting ring 110 is provided with external thread 111, the seat 230 is provided with thread hole 231, the external thread 111 is connected with the thread hole 231, thereby detachably connecting the seat 230 to the first connecting ring 110, which has a simple structure and is convenient to assemble and disassemble. Alternatively, the inner wall of the first connecting ring 110 is provided with internal thread, the seat 230 is provided with an a screw rod end, the screw rod end is connected with the internal thread, thereby detachably connecting the seat 230 to the first connecting ring 110, which has a simple structure and is convenient to assemble and disassemble. Preferably, the second sealing ring is disposed between the seat 230 and the first connecting ring 110, thereby further improving the sealing performance between the seat 230 and the first connecting ring 110.

In an embodiment, referring to FIGS. 8-9, the sealing seat 230 and the air-tight structure 200' are used at the same time. When the air hole 102 is closed, the air-tight structure 200 provides a primary gas sealing effect for the air hole 102 (namely, the gas in the cavity 101 cannot be discharged to the outside from the air port 270*a*). The sealing seat 230 provides a secondary gas sealing effect for the air hole 102, further improving the sealing property of the cavity 101 of the elastic airbag 100, stabilizing the state of the elastic airbag 100 after being inflated, and preventing natural air leakage.

In another embodiment, referring to FIGS. 8-9, the elastic airbag 100 includes an elastic airbag body 120 with an airbag port 120*a* and a cover body 130. Specifically, the elastic airbag body 120 can be made from silicone, rubber, or latex, etc., without further limitation. Wherein, the cover body 130 seals the airbag port 120*a*, the cavity 101 is formed between the cover body 130 and the elastic airbag body 120, the air hole 102 is arranged on the cover body 130, the cosmetic cover 300 is sleeved out of the elastic airbag body 120. The elastic airbag 100 is configured as a combination structure of the elastic airbag body 120 and the cover body 130 for easy processing.

In another embodiment, referring to FIGS. 8-9, the cosmetic cover 300 is detachably sleeved out of the elastic airbag body 120, when the elastic airbag body 120 is in a retracted state, it is easy for the users to assemble the cosmetic cover 300 on the elastic airbag body 120 or remove it from the elastic airbag body 120, making it convenient for cleaning, drying, or replacing. Compared with existing solid sponge puffs, the elastic airbag 100 can be recycled, and only the cosmetic cover 300 needs to be replaced, which reduces material loss, is economical and environmentally friendly, reduces manufacturing costs.

And, referring to FIG. 7 and FIG. 8, when used, only the cosmetic cover 300 applies liquid foundation, and the liquid foundation is adhesive on some range of the cosmetic cover 300. The elastic air bag 100 will not apply liquid foundation, reducing the waste of liquid foundation, and it is easy to clean and dry the cosmetic cover 300, which is clean and sanitary.

Specifically, referring to FIG. 8, the cosmetic cover 300 has an opening 310, the elastic airbag body 120 is inserted into the cosmetic cover 300 from the opening 310, so that the cosmetic cover 300 is detachably sheathed outside the elastic airbag body 120. The size of the opening 310 is smaller than that of the inner cavity of the cosmetic cover 300, so that the cosmetic cover 300 is firmly sleeved outside the elastic airbag body 120.

Further, referring to FIGS. 8-9, the elastic airbag body 120 is provided with a first sealing ring 121 in communication with the cavity 101, the ring opening of the first sealing ring 121 is the airbag port 120*a*. One end of the cover body 130 protrudes to form a second connecting ring 131, the second connecting ring 131 is inserted into the first sealing ring 121 so that the cover body 130 is hermetically connected to the first sealing ring 121 and covers the airbag port 120*a* with good sealing performance.

Further, referring to FIGS. 8-9, the periphery of the airbag port 120*a* is provided with a second sealing part 123, an end of the cover body 130 is provided with a second sealing groove 133, the second sealing part 123 is accommodated in the second sealing groove 133. the first sealing ring 121 is sleeved out of a pressing ring 140. The second sealing part 123 seals and presses between the cover body 130 and the pressing ring 140. The second sealing portion 123 is sealed and compressed by the cover body 130 and the pressing ring 140, thereby further improving the sealing tightness between the cover body 130 and the first sealing ring 121, stabilizing the state of the elastic airbag 100 after inflation, and preventing air leakage.

Specifically, the cover body 130, the second sealing part 123 and the pressing ring 140 can be fixed in a manner such as ultrasonic welding, glue bonding, or screwing.

Further, referring to FIGS. 7-8, the cover body 130 is smaller than the elastic airbag body 120, that is, the periphery of the cover body 130 does not protrude beyond the periphery of the elastic airbag body 120. When makeup is applied, the cosmetic cover 300 and the elastic airbag body 120 are deformed at a folded angle and tilted, thereby preventing the cover body 130 from making an impression on the makeup surface and the skin.

Figure 10:
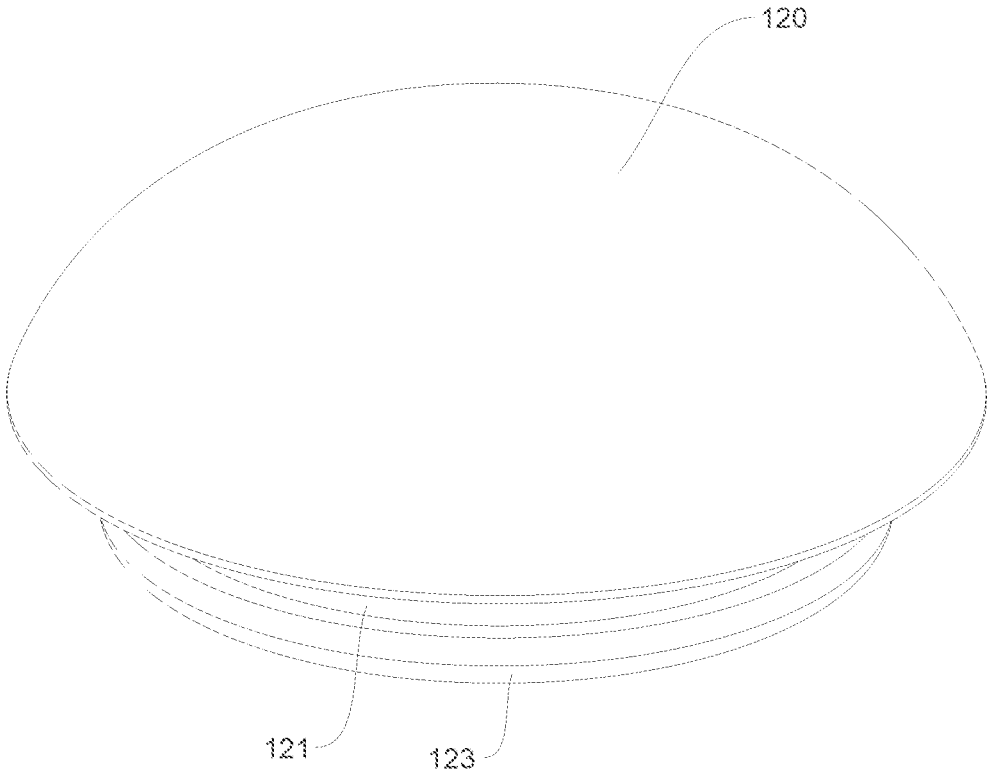
FIG. 10 is a perspective view of the elastic airbag according to an embodiment of the present disclosure.

In some embodiments, referring to FIGS. 8 and 10, the outer surface of the elastic airbag body 120 is smooth.

In an embodiment, referring to FIGS. 11-14, the outer surface of the elastic airbag body 120 is provided with a texture 126. The texture 126 may be of any shape and structure. The cosmetic sleeve 300 is sleeved outside the texture 126. Specifically, the user uses the cosmetic cover 300 to apply the foundation liquid, and the foundation liquid penetrates through the cosmetic cover 300 and enters the texture 126. When the user presses the skin using the cosmetic cover 300 to make up, the cosmetic cover 300 is pressed so that the outer surface of the elastic airbag 120 is pressed. Because there is contact and interaction between the elastic airbag 100 and the cosmetic cover 300, the texture 126 on the outer surface of the elastic airbag 120 is deformed by pressing and extrude the cosmetic case 300 to deform correspondingly or leave print on the cosmetic case 300. The liquid discharge holes of the cosmetic cover 300 form physical gaps of different sizes under the extrusion of the textures 126, and when the cosmetic cover 300 is in contact with the skin, different amounts of foundation powder and different softening effects or texture effects are released.

Figure 11:
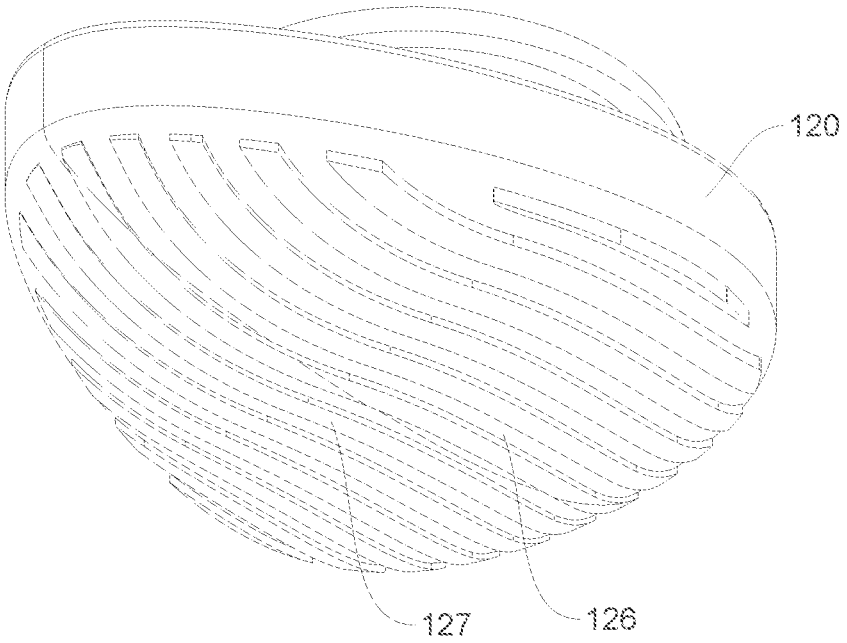
FIG. 11 is a perspective view of the elastic airbag according to another embodiment of the present disclosure.
Figure 12:
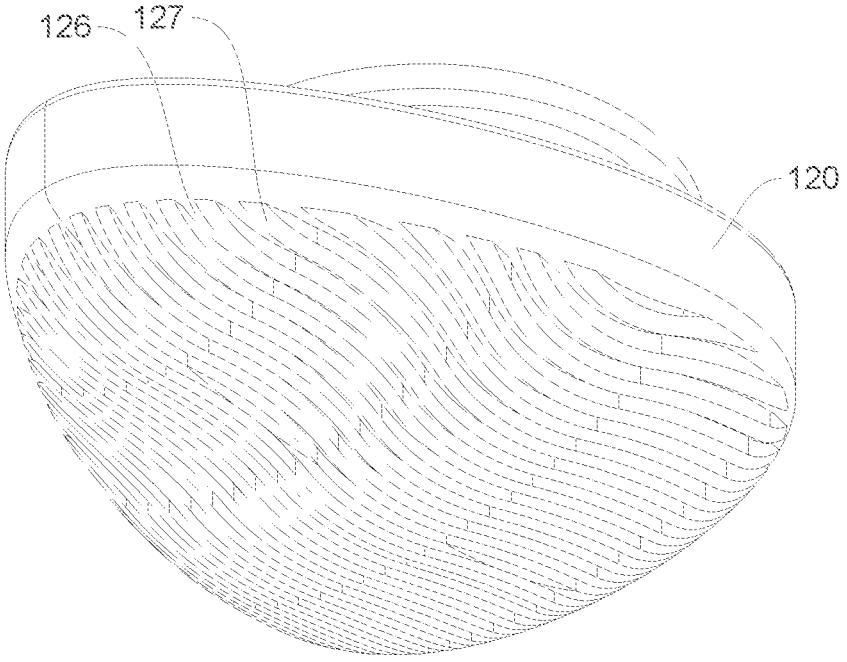
FIG. 12 is a perspective view of the elastic airbag according to another embodiment of the present disclosure.

In some embodiments, referring to FIGS. 11-12, the out surface of the elastic airbag body 120 is provided with a plurality of wave protrusions 127 which are regularly or irregularly distributed, the gap formed between the adjacent wave protrusions 127 is the described textures 126, and the size and the number of the wave protrusions can be determined according to actual production requirements or usage requirements, which are not limited here. For example, the larger the wave protrusion 127 is, the smaller the number is, the thicker the texture 126 is; on the contrary, the smaller the wave protrusion 127 is, the larger the number is, the thinner the texture 126 is.

Figure 13:
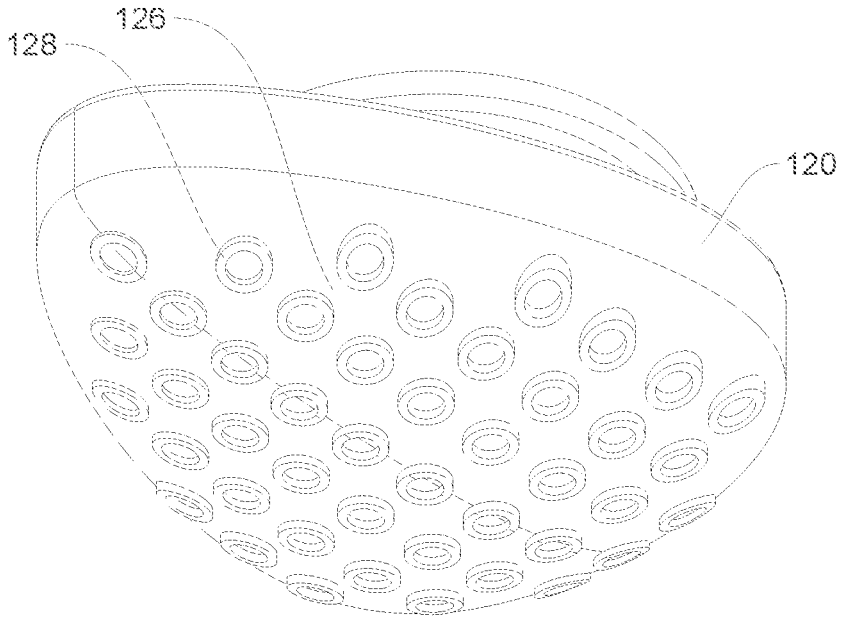
FIG. 13 is a perspective view of the elastic airbag according to another embodiment of the present disclosure.
Figure 14:
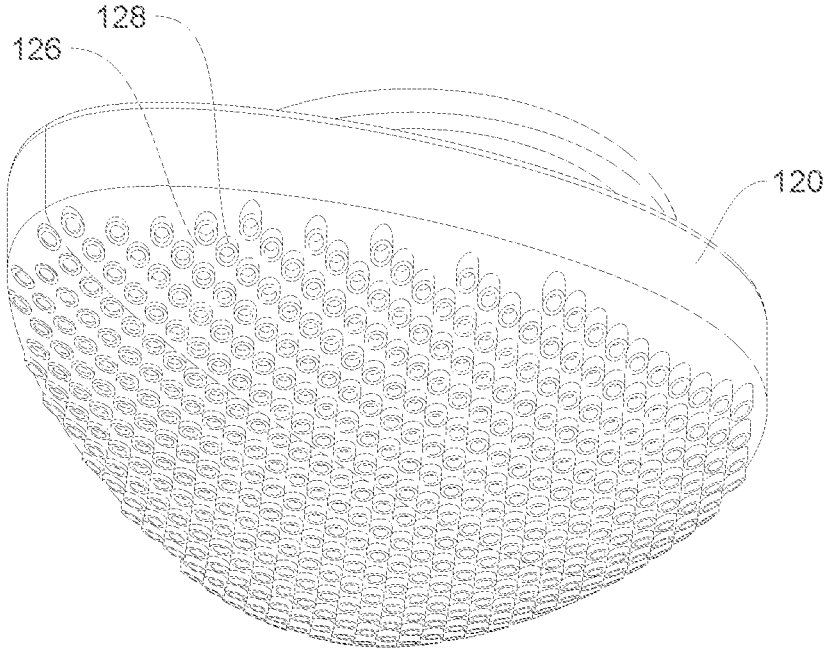
FIG. 14 is a perspective view of the elastic airbag according to another embodiment of the present disclosure.

In some embodiments, referring to FIGS. 13-14, the outer surface of the elastic airbag body 120 is provided with a plurality of convex circles or convex rings 128 which are regularly or irregularly distributed, the gap formed between the adjacent convex circles or the adjacent convex rings 128 is the described textures 126, and the size and the number of the convex circles or the convex rings 128 can be determined according to actual production requirements or usage requirements, which are not limited here. For example, the larger the convex circle or the convex ring 128 is, the smaller the number of the convex circle or the convex ring 128 is, the thicker the texture 126 is; on the contrary, the smaller the convex circle or the convex ring 128 is, the larger the number of the convex circle or the convex ring 128 is, the thinner the texture 126 is;

In other embodiments, the outer surface of the elastic airbag body 120 is provided with a plurality of grooves which are regularly distributed, irregularly distributed and/or cross distributed, and the gap between the grooves is the texture 126, or the outer surface of the elastic airbag body 120 may be provided with textures 126 having other shapes and structures, which is not limited herein.

Preferably, the cosmetic sleeve 300 is a sponge sleeve. The sponge sleeve has strong water absorption capacity and powder absorption capacity, so that the user can complete the cosmetic step more quickly, thereby saving the cosmetic time. The cosmetic sleeve is very practical for a busy daily life or a situation requiring fast cosmetic preparation.\

Specifically, the elastic airbag body 120 having different textures 126 may provide different pressure and support effects to the cosmetic sleeve 300, thereby affecting the touch of the skin of a person with the cosmetic sleeve 300. For example, the fine texture 126 makes the cosmetic sleeve 300 a soft and comfortable touch feeling, while the coarse texture 126 makes the sponge sheath a granular touch feeling, which is suitable for a lighter and thinner makeup surface.

Specifically, the textures 126 on the outer surface of the elastic airbag body 120 will improve the water absorption of the cosmetic sleeve 300, a distance exists between the outer surface of the elastic airbag body 120 and the cosmetic sleeve 300. The distance facilitates water storage (water absorption). The rough texture 126 makes the distance between the elastic airbag body 120 and the cosmetic sleeve 300 larger and has better water absorption; on the contrary, the fine texture 126 makes the distance between the elastic airbag body 120 and the cosmetic sleeve 300 smaller and has less water absorption Specifically, the rough texture 126 enables the cosmetic sleeve 300 to have a better powder absorption capacity, because the rough texture 126 provides more contact area and can adsorb and release the foundation more effectively, and this design is suitable for occasions requiring a large amount of foundation or requiring a strong concealing force. The fine texture 126 enables the cosmetic sleeve 300 to have a uniform coating effect, and since the texture 126 is fine, it can support the cosmetic sleeve 300 to better capture and adsorb fine particles in the foundation, Thus, the cosmetic sleeve 300 can be more finely coated, which reduces color difference, granular sensation and mottling phenomena, and makes the makeup more natural, This design is suitable for applications where a natural cosmetic effect is pursued, or where fine flaws, such as vaccinia, vaccinia prints or fine lines, need to be masked.

In conclusion, the thickness of the texture 126 has a significant impact on the cosmetic effect of the cosmetic sleeve 300. The elastic airbag body 120 with the thick texture 126 makes the cosmetic sleeve 300 more suitable for occasions requiring a large amount of foundation or requiring a stronger concealing force. The elastic airbag body 120 with the fine texture 126 makes the cosmetic sleeve 300 more suitable for occasions requiring a natural cosmetic effect. Accordingly, in selecting a powder puff, the user may select the elastic airbag body 120 with a suitable texture 126 depending on his/her needs and preferences.

Specifically, in certain particular applications, the texture 126 may achieve particular functional requirements. For example, in the medical or rehabilitative field, the texture 126 of the outer surface of the elastic airbag body 120 can be designed to provide specific massaging or irritating effects.

In the other embodiment, referring to FIGS. 8-9, the inner wall of the cavity 101 is provided with multiple strips 103, which are used to drive the elastic airbag 100 to recover from a retracted state and inhale autonomously into an expansion state. Specifically, the elastic airbag 100 is squeezed into the retracted state, the strips 103 is elastically deformed synchronously. When the air hole 102 is opened, the strips 103 elastically restores to drive the elastic airbag 100 to elastically restore to an expanded state from the retracted state, so that the elastic airbag 100 rapidly and autonomously inflates (inhales) into the expanded state, and the inflation speed is high.

It should be noted that the elastic airbag body 120 has elasticity, and the elastic airbag 100 can also be elastically restored to the expansion state from the retracted state without the strips 103. By the strips 103, the restoration (inflation) speed of the elastic airbag 100 can be improved.

Further, referring to FIGS. 8-9, the elastic airbag body 120 has a front end of a circular arc face 124, and the cosmetic cover 300 is in a shape matched with the elastic airbag body 120, facilitating makeup.

Further, referring to FIGS. 8-9, the strips 103 extends from one end of the circular arc face 124 of the cavity 101 to the other end along the inner wall of the cavity 101, so that the strips 103 have a strong elastic potential when being elastically deformed, thereby quickly driving the elastic airbag 100 to be elastically restored from the retracted state to the expansion state, and the restoring (inflation) speed is fast.

The elastic airbag body 120 may be configured as any shapes, correspondingly, the cosmetic cover 300 is configured as a shape matched with the elastic airbag body 120 so that the cosmetic cover 300 can sleeved out of the elastic airbag body 120.

Other parts of this embodiment are the same as those of the first embodiment, and features that are not explained in this embodiment are explained in the first embodiment, and will not be repeated here.

The present disclosure is described in further detail with reference to specific preferred embodiments, and it cannot be determined that the specific implementation of the present disclosure is only limited to these descriptions. For a person of ordinary skill in the art to which the present disclosure belongs, on the premise of not departing from the concept of the present disclosure, the architecture form of the present disclosure can be flexible and varied, and a series of products can be derived. Only a few simple deductions or replacements should be considered as belonging to the scope of protection defined by the claims as filed.

The invention claimed is:

1. A powder puff, comprising:

an elastic airbag, having a cavity, one end of said elastic airbag is provided with an air hole, an air-tight structure is arranged in said air hole and used for opening or closing said air hole; when said air hole is opened, said elastic airbag can be compressed into a retracted state, or inhaled spontaneously and restored elastically into an expanded state; and, a cosmetic cover, covering said elastic airbag;

wherein said elastic airbag includes an elastic airbag body with an airbag port and a cover body, said cover body seals said airbag port, said cavity is formed between said cover body and said elastic airbag body, said air hole is arranged on said cover body, said cosmetic cover covers said elastic airbag body;

wherein said elastic airbag body is provided with a first sealing ring in communication with said cavity, an opening of said first sealing ring is said airbag port; one end of said cover body protrudes to form a second connecting ring, said second connecting ring is inserted into said first sealing ring, and said first sealing ring and said second connecting ring are respectively provided with a first sealed part and a sealed groove clamped with each other.

2. The powder puff according to claim 1, wherein said air-tight structure includes a one-way valve and a first plug, said one-way valve is arranged in said air hole and used for an air entering said cavity by an air port of said one-way valve when said elastic airbag is restored elastically; said first plug is arranged in said air hole and used for opening said air port of said one-way valve when said elastic airbag is retracted.

3. The powder puff according to claim 2, wherein said one-way valve includes a valve body arranged in said air hole, said valve body is provided with an air channel having a port, an end of said air channel away from said port is provided with a V-shaped groove, a smaller end of said V-shaped groove faces said cavity, a bottom of said V-shaped groove is provided with said air port, and when said elastic airbag is elastically restored, external air props open said air port into said cavity.

4. The powder puff according to claim 3, wherein said first plug includes an elastic part, arranged between said air hole and said valve body; opposite ends of said elastic part are respectively provided with a first plug end and a first pressing end, said first plug end penetrates through said air channel and has a gap therebetween, and said first pressing end extends towards said air hole; pressing said first pressing end to drive said first plug end to insert into said V-shaped groove for opening said air port; and said elastic part drives said first plug end to reset and be away from said V-shaped groove for closing said air port.

5. The powder puff according to claim 1, wherein said elastic airbag body is provided with a first connecting ring in communication with said cavity, a ring hole of said first connecting ring is said air hole, said air-tight structure includes a seat detachably connected with said first connecting ring and sealed said air hole.

6. The powder puff according to claim 5, wherein an outer wall of said first connecting ring is provided with external thread, said seat is provided with a threaded hole, and said external thread is connected with said threaded hole.

7. The powder puff according to claim 1, wherein a periphery of said airbag port is provided with a second sealing part, an end of said cover body is provided with a second sealing groove, said second sealing part is accommodated in said second groove, a pressing ring is covered by said first sealing ring, said second sealing part is sealed and pressed between said cover body and said pressing ring.

8. The powder puff according to claim 1, wherein an inner wall of said cavity is provided with multiple strips, and said multiple strips are used to drive said elastic airbag to recover from a retracted state, and to inhale autonomously into an expansion state.

* * * * *